US012366376B2

(12) United States Patent
Homman et al.

(10) Patent No.: US 12,366,376 B2
(45) Date of Patent: Jul. 22, 2025

(54) METHODS FOR SABBATH MODE IN AIR CONDITIONING UNITS

(71) Applicant: Haier US Appliance Solutions, Inc., Wilmington, DE (US)

(72) Inventors: Vincent Kai Homman, Louisville, KY (US); Brian Bernard McKay, Louisville, KY (US); Jian Cui, Shanghai (CN); Kyle James Tear, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/796,428

(22) PCT Filed: Jun. 2, 2022

(86) PCT No.: PCT/CN2022/096801

§ 371 (c)(1),
(2) Date: Jul. 29, 2022

(87) PCT Pub. No.: WO2023/230981

PCT Pub. Date: Dec. 7, 2023

(65) Prior Publication Data

US 2024/0183558 A1 Jun. 6, 2024

(51) Int. Cl.

| | |
|---|---|
| ***F24F 11/64*** | (2018.01) |
| ***F24F 11/84*** | (2018.01) |
| *F24F 110/10* | (2018.01) |

(52) U.S. Cl.

CPC ..... *F24F 11/64* (2018.01); *F24F 11/84* (2018.01); *F24F 2110/10* (2018.01)

(58) Field of Classification Search

CPC .. F24F 11/30; F24F 11/64; F24F 11/86; F24F 11/84; F24F 2110/10; F24F 1/02; F24F 11/63; F24F 11/61; F24F 13/24; F24F 11/871; F25B 49/022; F25B 2600/021

See application file for complete search history.

(56) References Cited

U.S. PATENT DOCUMENTS

| | | | | |
|---|---|---|---|---|
| 4,724,680 | A * | 2/1988 | Kawai | F24F 11/88 318/807 |
| 8,943,845 | B2 | 2/2015 | Lafleur et al. | |
| 10,830,523 | B2 | 11/2020 | Franks et al. | |

(Continued)

FOREIGN PATENT DOCUMENTS

| | | | |
|---|---|---|---|
| CN | 201589491 | U | 9/2010 |
| CN | 102840645 | A | 12/2012 |

(Continued)

OTHER PUBLICATIONS

International Search Report Corresponding to Application No. PCT/CN2022/096801 on Dec. 19, 2022.

*Primary Examiner* — Alicia M. Choi
(74) *Attorney, Agent, or Firm* — Dority & Manning, P.A.

(57) ABSTRACT

A method of Sabbath mode in an air conditioning unit includes receiving, at a controller of the air conditioning unit, a temperature signal from a temperature sensor, while in the Sabbath mode. Then determining that the temperature signal is one of above or below a threshold value, while in the Sabbath mode. Followed by adjusting, with the controller of the air conditioning unit, operation of a compressor in the air conditioning unit, while in the Sabbath mode.

15 Claims, 9 Drawing Sheets

(56) References Cited

U.S. PATENT DOCUMENTS

| | | | | |
|---|---|---|---|---|
| 2003/0040842 | A1* | 2/2003 | Poth | F24F 11/30 700/278 |
| 2013/0253725 | A1 | 9/2013 | Ezra | |
| 2014/0148967 | A1 | 5/2014 | Bayfus | |
| 2016/0216187 | A1 | 7/2016 | Gao et al. | |
| 2017/0097187 | A1* | 4/2017 | Thea | F25D 29/00 |
| 2017/0198934 | A1* | 7/2017 | Shaffer | F24F 11/30 |
| 2018/0320918 | A1* | 11/2018 | Kojima | G05B 19/02 |
| 2019/0372800 | A1 | 12/2019 | Cohen | |

FOREIGN PATENT DOCUMENTS

| | | | | |
|---|---|---|---|---|
| CN | 103411383 | A | | 11/2013 |
| CN | 111023426 | A | | 4/2020 |
| CN | 113819586 | A | | 12/2021 |
| CN | 113932415 | A | * | 1/2022 |

* cited by examiner

METHODS FOR SABBATH MODE IN AIR CONDITIONING UNITS

CROSS-REFERENCE TO RELATED APPLICATIONS

The present application is the National Stage Entry of and claims the benefit of priority under 35 U.S.C. § 371 to PCT Application Serial No. PCT/CN2022/096801 filed Jun. 2, 2022 and entitled METHODS FOR SABBATH MODE IN AIR CONDITIONING UNITS, which is hereby incorporated by reference in its entirety for all purposes.

FIELD OF THE INVENTION

The present subject matter relates generally to Sabbath operating modes in air conditioning units.

BACKGROUND OF THE INVENTION

Air-conditioner (AC) or conditioning units are conventionally utilized to adjust the temperature indoors, e.g., within structures, such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed within the indoors that is connected to another portion located outdoors, e.g., by tubing or conduit carrying refrigerant. These types of units are typically used for conditioning the air in larger spaces.

An inverter window air-conditioning (AC) unit is another type of AC unit. Inverter window ACs generally are more cost effective, more energy efficient, and provide better cooling than a non-inverter unit. An inverter is used to regulate the speed of a compressor motor in order to adjust the temperature. The main feature of an inverter AC is the ability to control the compressor motor speed. The regulated speed allows the unit to maintain the temperature without having to power down the motor, thus an inverter AC unit is more energy-efficient than non-inverter units.

Certain religious customs, such as Orthodox Jewish customs, require that certain traditions be maintained during designated times or holidays, which can influence how certain appliances, such as AC units, may be used. For instance, the Sabbath (i.e., Shabbos or Shabbat) is set aside as a time when no work should be performed. This prohibition on work may apply not only to an observer's direct physical actions, but also to actions initiated through the observer's appliances. For instance, the observer may be required to abstain from causing an appliance to change its normal pattern of operation. In other words, a user may be prohibited from actions that would result in a direct response from the appliance, such as activating a heating element or heat-adjusting system.

BRIEF DESCRIPTION OF THE INVENTION

Aspects and advantages of the invention will be set forth in part in the following description, or may be apparent from the description, or may be learned through practice of the invention.

In one embodiment, a method of Sabbath mode in an air conditioning unit includes determining, at a controller of the air conditioning unit, that a Sabbath mode is active. Then receiving, at the controller of the air conditioning unit, a temperature signal from a temperature sensor, while in the Sabbath mode. Followed by, determining, at the controller of the air conditioning unit, that the temperature signal is one of above or below a threshold value, while in the Sabbath mode. Then adjusting, with the controller of the air conditioning unit, operation of a compressor in the air conditioning unit, while in the Sabbath mode.

In another embodiment, a method of Sabbath mode in an inverter window air conditioning unit includes receiving, at a controller of the air conditioning unit, a temperature signal from an external temperature sensor. Then determining, at the controller of the air conditioning unit, that the temperature signal from the external temperature sensor is above a threshold value of about eighteen degrees Celsius. Followed by initiating, with the controller of the air conditioning unit, operation of a compressor in the air conditioning unit. Then determining, at the controller of the air conditioning unit, that a random length of time between thirty seconds and ninety seconds has passed since the initiation of the compressor. Followed by, determining, at the controller of the air conditioning unit, that a room temperature is one of above or below a set temperature, plus about two additional degrees. Then deactivating, with the controller of the air conditioning unit, operation of the compressor in the air conditioning unit. Then determining, at the controller of the air conditioning unit, that a length of time of at least ten minutes has passed.

In another example embodiment, an inverter window air conditioning unit, includes a housing with an interior heat exchanger positioned within the housing at an inside portion of the housing, and an exterior heat exchanger positioned within the housing at an outside portion of the housing. Also included is a compressor operable to flow working fluid through the interior and exterior heat exchangers, and a temperature sensor configured for measuring a temperature of air. A controller is configured for determining that a Sabbath mode is active, receiving a temperature signal from the temperature sensor while in the Sabbath mode, and determining that the temperature signal is one of above or below a threshold value while in the Sabbath mode. Then, adjusting operation of the compressor while in the Sabbath mode.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
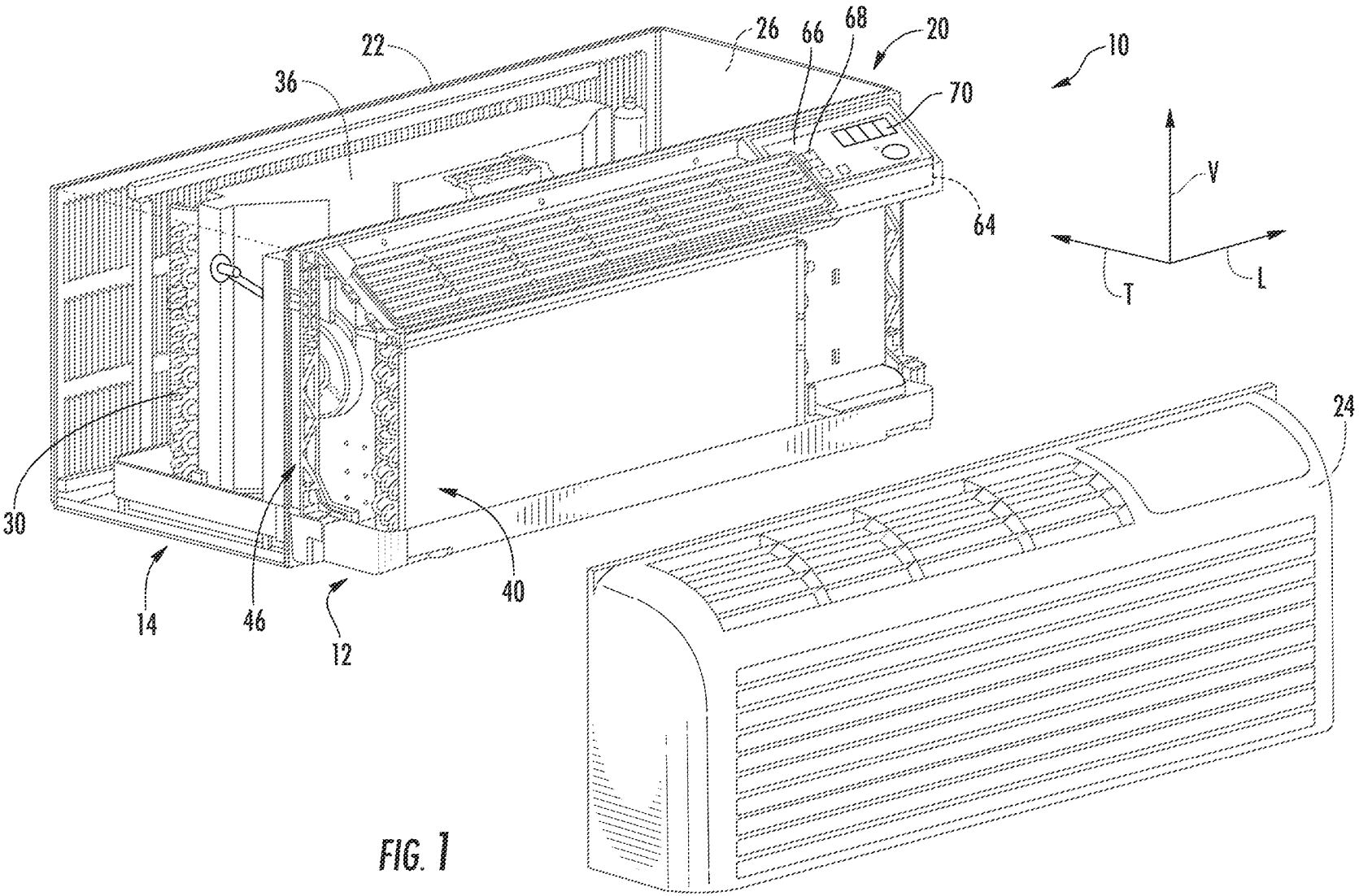
FIG. 1 provides a perspective view of an air conditioner unit, with part of an indoor portion exploded from a remainder of the air conditioner unit for illustrative purposes, in accordance with one exemplary embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
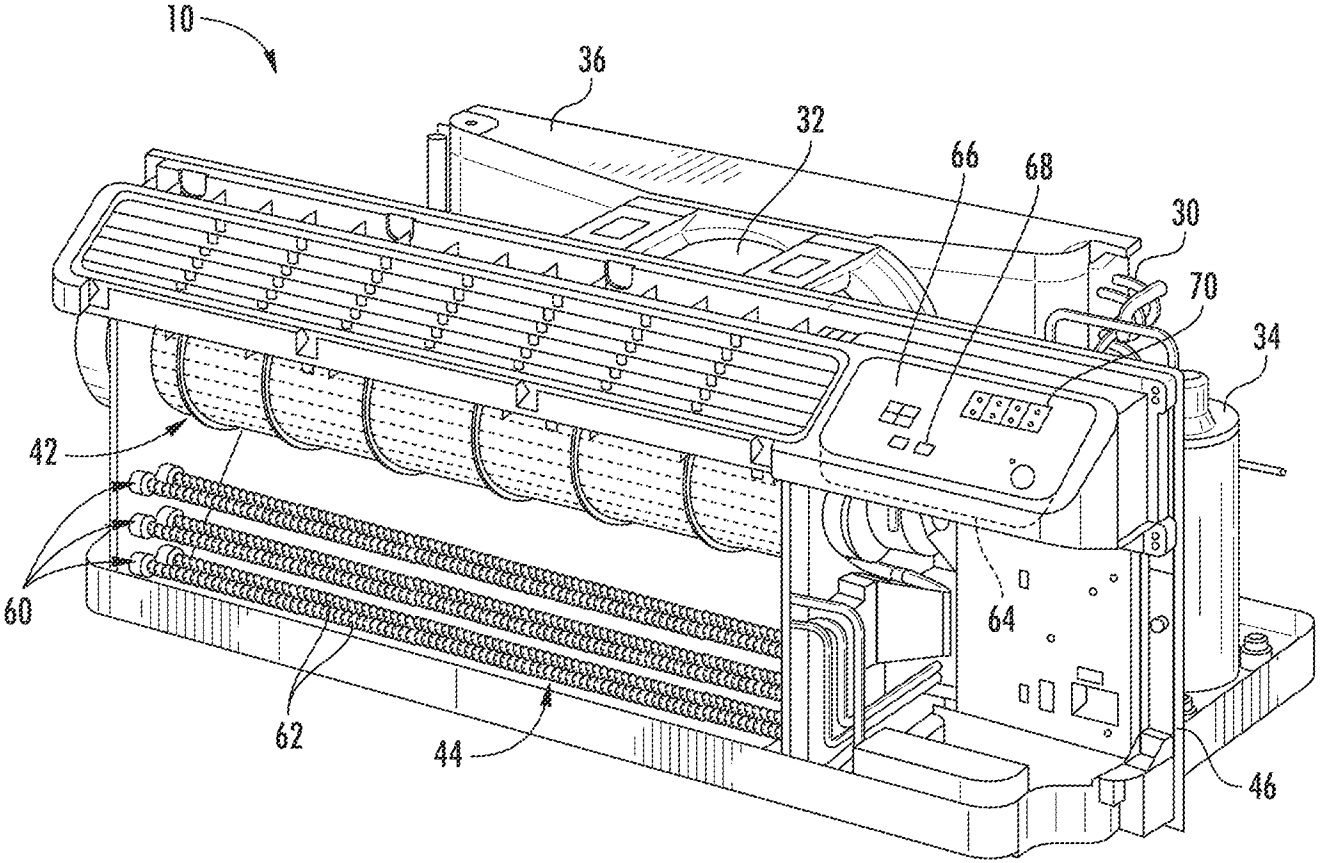
FIG. 2 is another perspective view of components of the indoor portion of the exemplary air conditioner unit of FIG. 1.

Referring now to FIGS. 1 and 2, an air conditioner unit 10 is provided. The air conditioner unit 10 is a one-unit type air conditioner, also conventionally referred to as a room air conditioner or a packaged terminal air conditioner (PTAC). The unit 10 includes an indoor portion 12 and an outdoor portion 14, and generally defines a vertical direction V, a lateral direction L, and a transverse direction T. Each direction V, L, T is perpendicular to each other, such that an orthogonal coordinate system is generally defined. Although aspects of the present subject matter are described with reference to PTAC unit 10, it should be appreciated that aspects of the present subject matter may be equally applicable to other air conditioner unit types and configurations, such as inverter window air conditioners (WACs) and split heat pump systems.

A housing 20 of the unit 10 may contain various other components of the unit 10. Housing 20 may include, for example, a rear grill 22 and a room front 24 which may be spaced apart along the transverse direction T by a wall sleeve 26. The rear grill 22 may be part of the outdoor portion 14, and the room front 24 may be part of the indoor portion 12. Components of the outdoor portion 14, such as an outdoor heat exchanger 30, an outdoor fan 32, and a compressor 34 may be housed within the wall sleeve 26. A fan shroud 36 may additionally enclose outdoor fan 32, as shown.

Indoor portion 12 may include, for example, an indoor heat exchanger 40, a blower fan or indoor fan 42, and a heating unit 44. These components may, for example, be housed behind the room front 24. Additionally, a bulkhead 46 may generally support and/or house various other components or portions thereof of the indoor portion 12, such as indoor fan 42 and the heating unit 44. Bulkhead 46 may generally separate and define the indoor portion 12 and outdoor portion 14.

Figure 3:
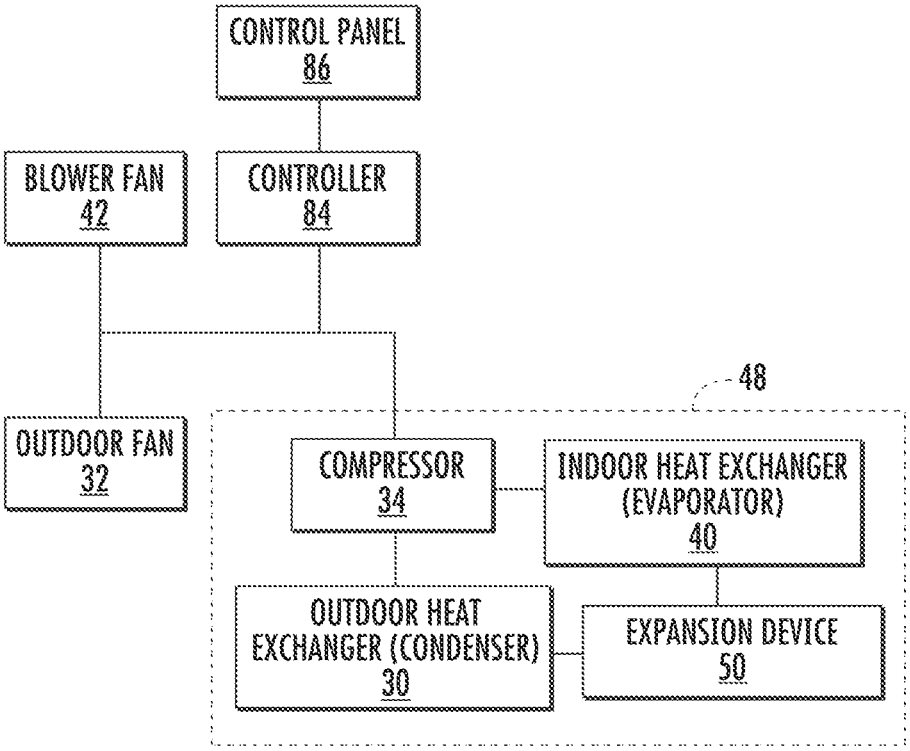
FIG. 3 is a schematic view of a refrigeration loop in accordance with one example embodiment of the present disclosure.

Outdoor and indoor heat exchangers 30, 40 may be components of a sealed system or refrigeration loop 48, which is shown schematically in FIG. 3. Refrigeration loop 48 may, for example, further include compressor 34 and an expansion device 50. As illustrated, compressor 34 and expansion device 50 may be in fluid communication with outdoor heat exchanger 30 and indoor heat exchanger 40 to flow refrigerant therethrough as is generally understood. More particularly, refrigeration loop 48 may include various lines for flowing refrigerant between the various components of refrigeration loop 48, thus providing the fluid communication there between. Refrigerant may thus flow through such lines from indoor heat exchanger 40 to compressor 34, from compressor 34 to outdoor heat exchanger 30, from outdoor heat exchanger 30 to expansion device 50, and from expansion device 50 to indoor heat exchanger 40. The refrigerant may generally undergo phase changes associated with a refrigeration cycle as it flows to and through these various components, as is generally understood. Suitable refrigerants for use in refrigeration loop 48 may include pentafluoroethane, difluoromethane, or a mixture such as R410a, although it should be understood that the present disclosure is not limited to such examples and rather that any suitable refrigerant may be utilized.

As is understood in the art, refrigeration loop 48 may be alternately operated as a refrigeration assembly (and thus perform a refrigeration cycle) or a heat pump (and thus perform a heat pump cycle). As shown in FIG. 3, when refrigeration loop 48 is operating in a cooling mode and thus performing a refrigeration cycle, the indoor heat exchanger 40 acts as an evaporator and the outdoor heat exchanger 30 acts as a condenser. Alternatively, when the assembly is operating in a heating mode and thus performs a heat pump cycle, the indoor heat exchanger 40 acts as a condenser and the outdoor heat exchanger 30 acts as an evaporator. The outdoor and indoor heat exchangers 30, 40 may each include coils through which a refrigerant may flow for heat exchange purposes, as is generally understood.

According to an example embodiment, compressor 34 may be a variable speed compressor. In this regard, compressor 34 may be operated at various speeds depending on the current air conditioning needs of the room and the demand from refrigeration loop 48. For example, according to an example embodiment, compressor 34 may be configured to operate at any speed between a minimum speed, e.g., 1500 revolutions per minute (RPM), to a maximum rated speed, e.g., 3500 RPM. Notably, use of variable speed compressor 34 enables efficient operation of refrigeration loop 48 (and thus air conditioner unit 10), minimizes unnecessary noise when compressor 34 does not need to operate at full speed, and ensures a comfortable environment within the room.

Specifically, according to an example embodiment, compressor 34 may be an inverter compressor. In this regard, compressor 34 may include a power inverter, power electronic devices, rectifiers, or other control electronics suitable for converting an alternating current (AC) power input into a direct current (DC) power supply for the compressor. The inverter electronics may regulate the DC power output to any suitable DC voltage that corresponds to a specific operating speed of compressor. In this manner compressor 34 may be regulated to any suitable operating speed, e.g., from 0% to 100% of the full rated power and/or speed of the compressor. This may facilitate precise compressor operation at the desired operating power and speed, thus meeting system needs while maximizing efficiency and minimizing unnecessary system cycling, energy usage, and noise.

In example embodiments as illustrated, expansion device 50 may be disposed in the outdoor portion 14 between the indoor heat exchanger 40 and the outdoor heat exchanger 30. According to the example embodiment, expansion device 50 may be an electronic expansion valve ("EEV") that enables controlled expansion of refrigerant, as is known in the art. According to alternative embodiments, expansion device 50 may be a capillary tube or another suitable expansion device configured for use in a thermodynamic cycle.

More specifically, according to example embodiments, electronic expansion device 50 may be configured to precisely control the expansion of refrigerant to maintain, for example, a desired temperature differential of the refrigerant across the evaporator (i.e., the outdoor heat exchanger 30 in heat pump mode). In other words, electronic expansion device 50 throttles the flow of refrigerant based on the reaction of the temperature differential across the evaporator or the amount of superheat temperature differential, thereby ensuring that the refrigerant is in the gaseous state entering compressor 34.

In general, the terms "superheat," "operating superheat," or the like are generally intended to refer to the temperature increase of the refrigerant past the fully saturated vapor temperature in the evaporator. In this regard, for example, the superheat may be quantified in degrees Fahrenheit, e.g., such that 1° F superheat means that the refrigerant exiting the evaporator is 1° F. higher than the saturated vapor temperature. It should be appreciated that the operating superheat may be measured and monitored by controller 64 in any suitable manner. For example, controller may be operably coupled to a pressure sensor for measuring the refrigerant pressure exiting the evaporator, may convert that pressure to the saturated vapor temperature, and may subtract that temperature from the measured refrigerant temperature at the evaporator outlet to determine superheat.

According to the illustrated example embodiment, outdoor fan 32 is an axial fan and indoor fan 42 is a centrifugal fan. However, it should be appreciated that according to alternative embodiments, outdoor fan 32 and indoor fan 42 may be any suitable fan type. In addition, according to an example embodiment, outdoor fan 32 and indoor fan 42 are variable speed fans, e.g., similar to variable speed compressor 34. For example, outdoor fan 32 and indoor fan 42 may rotate at different rotational speeds, thereby generating different air flow rates. It may be desirable to operate fans 32, 42 at less than their maximum rated speed to ensure safe and proper operation of refrigeration loop 48 at less than its maximum rated speed, e.g., to reduce noise when full speed operation is not needed. In addition, according to alternative embodiments, fans 32, 42 may be operated to urge make-up air into the room.

According to the illustrated embodiment, indoor fan 42 may operate as an evaporator fan in refrigeration loop 48 to encourage the flow of air through indoor heat exchanger 40. Accordingly, indoor fan 42 may be positioned downstream of indoor heat exchanger 40 along the flow direction of indoor air and downstream of heating unit 44. Alternatively, indoor fan 42 may be positioned upstream of indoor heat exchanger 40 along the flow direction of indoor air and may operate to push air through indoor heat exchanger 40.

Heating unit 44 in example embodiments includes one or more heater banks 60. Each heater bank 60 may be operated as desired to produce heat. In some embodiments as shown, three heater banks 60 may be utilized. Alternatively, however, any suitable number of heater banks 60 may be utilized. Each heater bank 60 may further include at least one heater coil or coil pass 62, such as in example embodiments two heater coils or coil passes 62. Alternatively, other suitable heating elements may be utilized.

The operation of air conditioner unit 10 including compressor 34 (and thus refrigeration loop 48 generally) indoor fan 42, outdoor fan 32, heating unit 44, expansion device 50, and other components of refrigeration loop 48 may be controlled by a processing device such as a controller 64. Controller 64 may be in communication (via for example a suitable wired or wireless connection) to such components of the air conditioner unit 10. Controller 64 may include a memory and one or more processing devices such as microprocessors, CPUs or the like, such as general or special purpose microprocessors operable to execute programming instructions or micro-control code associated with operation of unit 10. The memory may represent random access memory such as DRAM, or read only memory such as ROM or FLASH. In one embodiment, the processor executes programming instructions stored in memory. The memory may be a separate component from the processor or may be included onboard within the processor.

Unit 10 may additionally include a control panel 66 and one or more user inputs 68, which may be included in control panel 66. The user inputs 68 may be in communication with the controller 64. A user of the unit 10 may interact with the user inputs 68 to operate the unit 10, and user commands may be transmitted between the user inputs 68 and controller 64 to facilitate operation of the unit 10 based on such user commands. A display 70 may additionally be provided in the control panel 66 and may be in communication with the controller 64. Display 70 may, for example be a touchscreen or other text-readable display screen, or alternatively may simply be a light that can be activated and deactivated as required to provide an indication of, for example, an event or setting for the unit 10.

Figure 4:
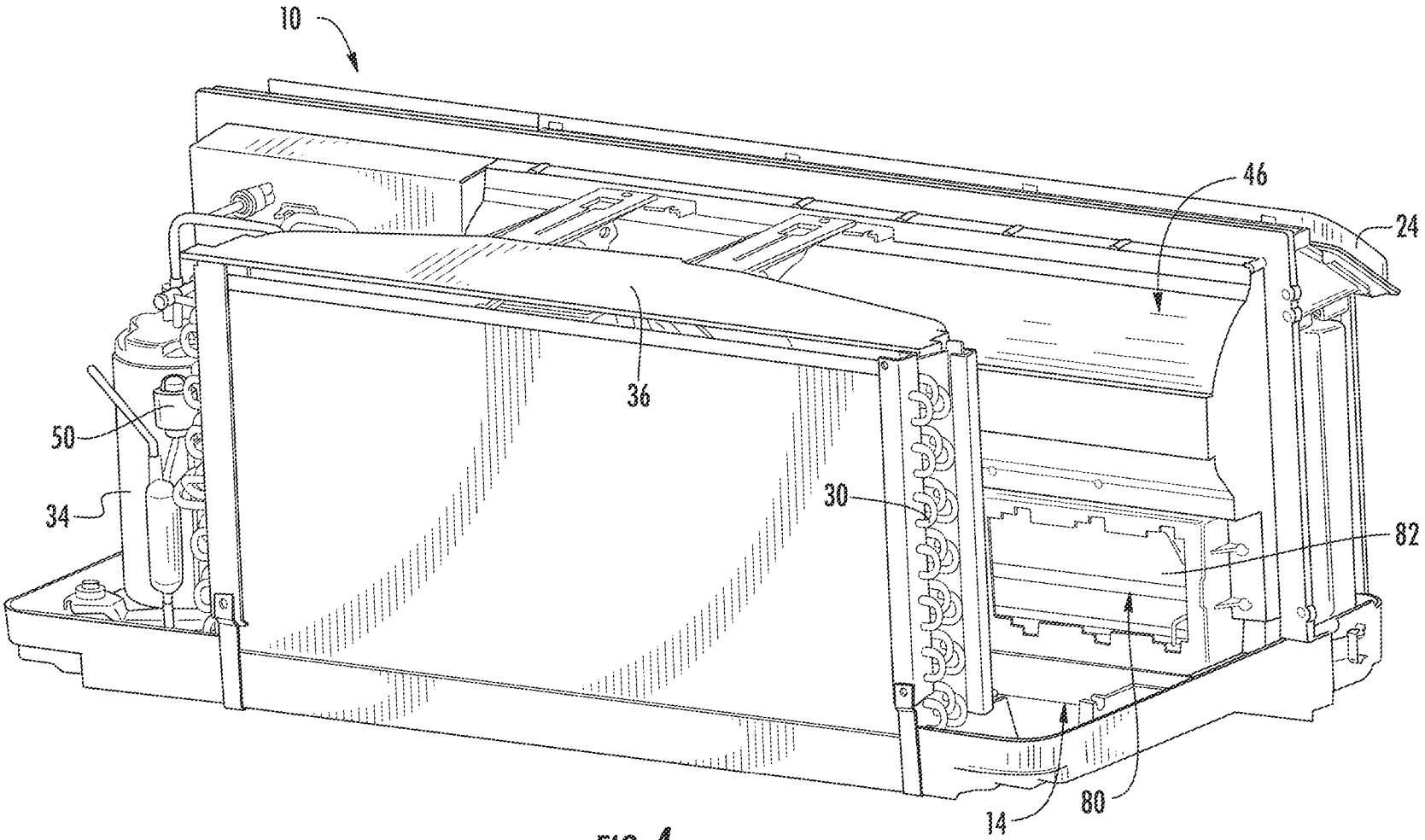
FIG. 4 is a rear perspective view of an outdoor portion of the exemplary air conditioner unit of FIG. 1, illustrating a vent aperture in a bulkhead in accordance with one example embodiment of the present disclosure.

Referring briefly to FIG. 4, a vent aperture 80 may be defined in bulkhead 46 for providing fluid communication between indoor portion 12 and outdoor portion 14. Vent aperture 80 may be utilized in an installed air conditioner unit 10 to allow outdoor air to flow into the room through the indoor portion 12. In this regard, in some cases it may be desirable to allow outside air (i.e., "make-up air") to flow into the room in order, e.g., to meet government regulations, to compensate for negative pressure created within the room, etc. In this manner, according to an example embodiment, make-up air may be provided into the room through vent aperture 80 when desired.

Figure 5:
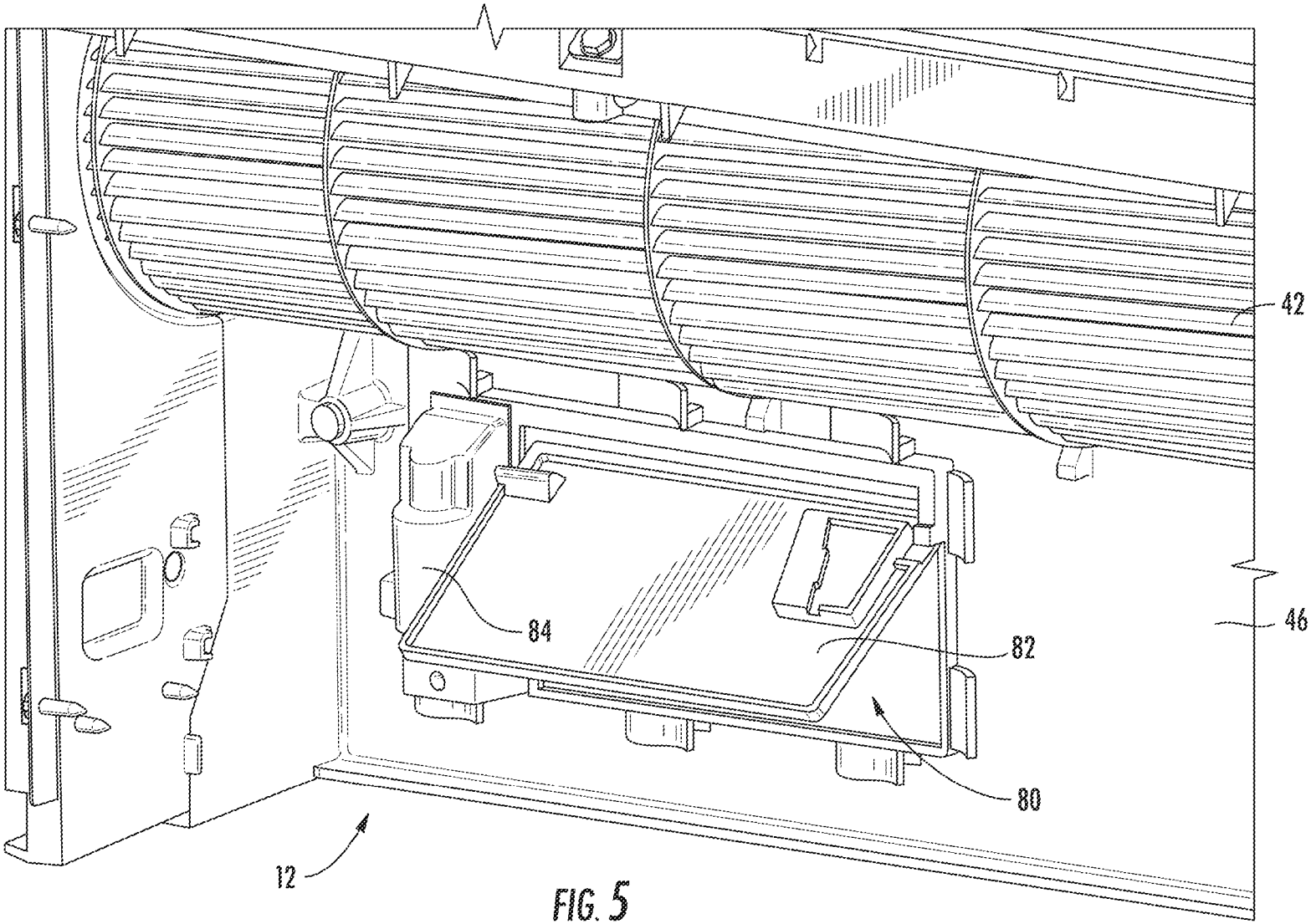
FIG. 5 is a front perspective view of the exemplary bulkhead of FIG. 4 with a vent door illustrated in the open position in accordance with one example embodiment of the present disclosure.

As shown in FIG. 5, a vent door 82 may be pivotally mounted to the bulkhead 46 proximate to vent aperture 80 to open and close vent aperture 80. More specifically, as illustrated, vent door 82 is pivotally mounted to the indoor facing surface of indoor portion 12. Vent door 82 may be configured to pivot between a first, closed position where vent door 82 prevents air from flowing between outdoor portion 14 and indoor portion 12, and a second, open position where vent door 82 is in an open position (as shown in FIG. 5) and allows make-up air to flow into the room. According to the illustrated embodiment vent door 82 may be pivoted between the open and closed position by an electric motor 84 controlled by controller 64, or by any other suitable method.

In some cases, it may be desirable to treat or condition make-up air flowing through vent aperture 80 prior to blowing it into the room. For example, outdoor air which has a relatively high humidity level may require treating before passing into the room. In addition, if the outdoor air is cool, it may be desirable to heat the air before blowing it into the room. Therefore, according to an example embodiment of the present subject matter, unit 10 may further include an auxiliary sealed system that is positioned over vent aperture 80 for conditioning make-up air. The auxiliary sealed system may be a miniature sealed system that acts similar to refrigeration loop 48, but conditions only the air flowing through vent aperture 80. According to alternative embodiments, such as that described herein, make-up air may be urged through vent aperture 80 without the assistance of an auxiliary sealed system. Instead, make-up air is urged through vent aperture 80 may be conditioned at least in part by refrigeration loop 48, e.g., by passing through indoor heat exchanger 40. Additionally, the make-up air may be conditioned immediately upon entrance through vent aperture 80 or sequentially after combining with the air stream induced through indoor heat exchanger 40.

Figure 6:
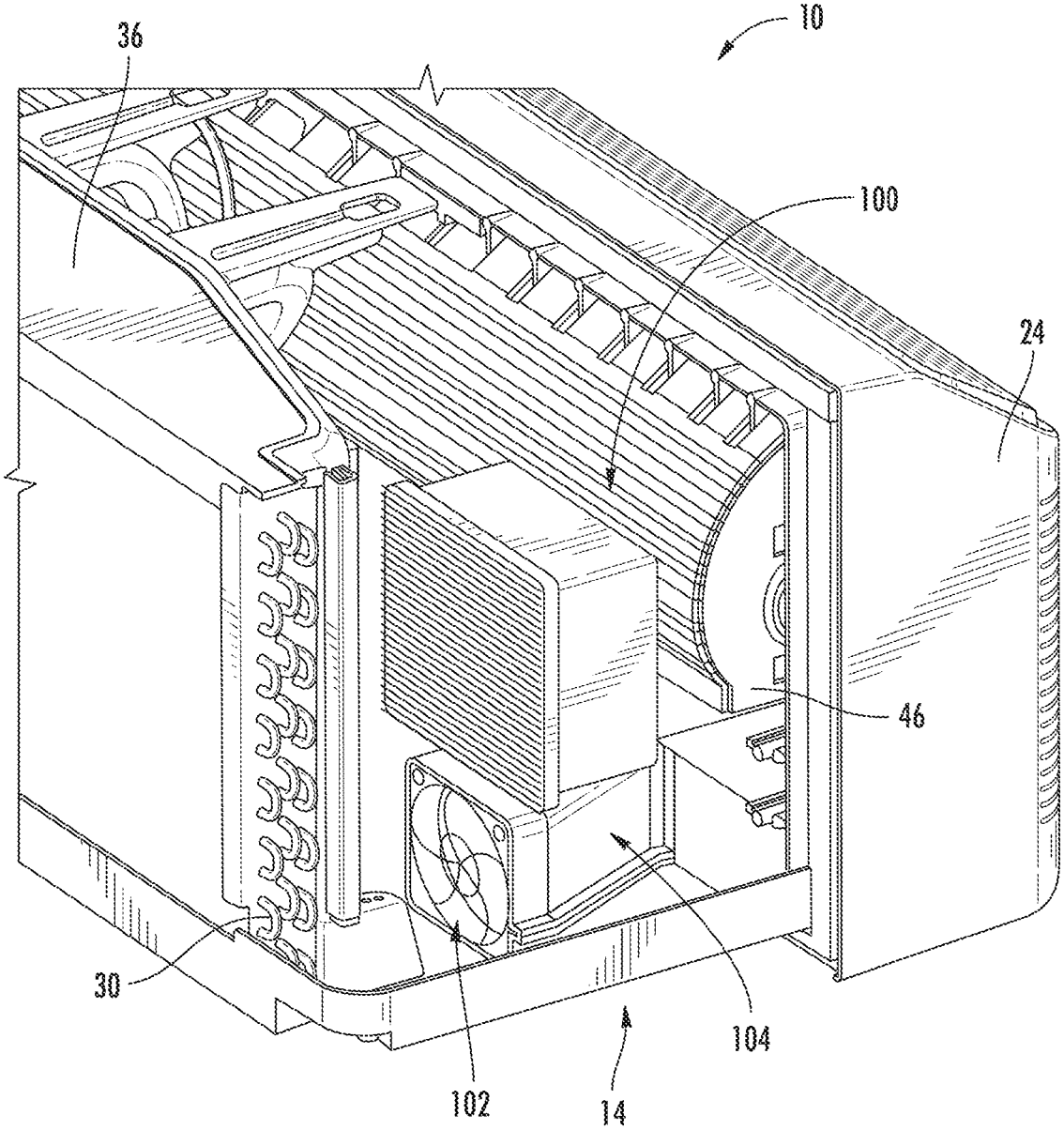
FIG. 6 is a rear perspective view of the exemplary air conditioner unit and bulkhead of FIG. 4 including a fan assembly for providing make-up air in accordance with one example embodiment of the present disclosure.

Referring now to FIG. 6, a fan assembly 100 will be described according to an example embodiment of the present subject matter. According to the illustrated embodiment, fan assembly 100 is generally configured for urging the flow of makeup air through vent aperture 80 and into a conditioned room without the assistance of an auxiliary sealed system. However, it should be appreciated that fan assembly 100 could be used in conjunction with a make-up air module including an auxiliary sealed system for conditioning the flow of make-up air. As illustrated, fan assembly 100 includes an auxiliary fan 102 for urging a flow of make-up air through a fan duct 104 and into indoor portion 12 through vent aperture 80.

According to the illustrated embodiment, auxiliary fan 102 is an axial fan positioned at an inlet of fan duct 104, e.g., upstream from vent aperture 80. However, it should be appreciated that any other suitable number, type, and configuration of fan or blower could be used to urge a flow of makeup air according to alternative embodiments. In addition, auxiliary fan 102 may be positioned in any other suitable location within air conditioner unit 10 and auxiliary fan 102 may be positioned at any other suitable location within or in fluid communication with fan duct 104. The embodiments described herein are only example and are not intended to limit the scope present subject matter.

Figure 7:
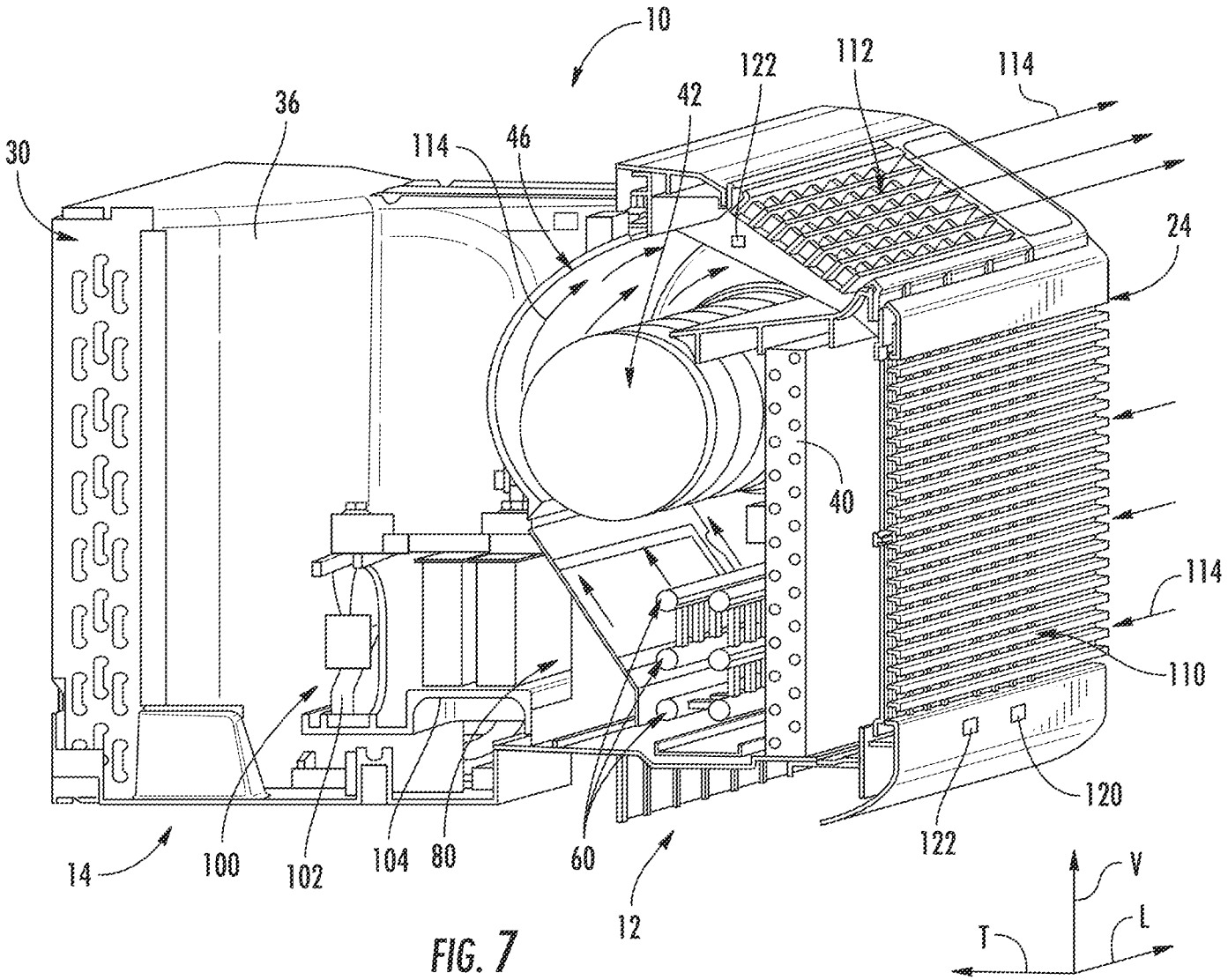
FIG. 7 is a side cross sectional view of the exemplary air conditioner unit of FIG. 1.

Referring now to FIG. 7, operation of unit 10 will be described according to an example embodiment. More specifically, the operation of components within indoor portion 12 will be described during a cooling operation or cooling cycle of unit 10. To simplify discussion, the operation of auxiliary fan 102 for providing make-up air through vent aperture 80 will be omitted, e.g., as if vent door 82 were closed. Although a cooling cycle will be described, it should be further appreciated that indoor heat exchanger 40 and/or heating unit 44 be used to heat indoor air according to alternative embodiments. Moreover, although operation of unit 10 is described below for the example packaged terminal air conditioner unit, it should be further appreciated that aspects the present subject matter may be used in any other suitable air conditioner unit, such as a heat pump or split unit system.

As illustrated, room front 24 of unit 10 generally defines an intake vent 110 and a discharge vent 112 for use in circulating a flow of air (indicated by arrows 114) throughout a room. In this regard, indoor fan 42 is generally configured for drawing in air 114 through intake vent 110 and urging the flow of air through indoor heat exchanger 40 before discharging the air 114 out of discharge vent 112. According to the illustrated embodiment, intake vent 110 is positioned proximate a bottom of unit 10 and discharge vent 112 is positioned proximate a top of unit 10. However, it should be appreciated that according to alternative embodiments, intake vent 110 and discharge vent 112 may have any other suitable size, shape, position, or configuration.

During a cooling cycle, refrigeration loop 48 is generally configured for urging cold refrigerant through indoor heat exchanger 40 in order to lower the temperature of the flow of air 114 before discharging it back into the room. Specifically, during a cooling operation, controller 64 may be provided with a target temperature, e.g., as set by a user for the desired room temperature. In general, components of refrigeration loop 48, outdoor fan 32, indoor fan 42, and other components of unit 10 operate to continuously cool the flow of air.

In order to facilitate operation of refrigeration loop 48 and other components of unit 10, unit 10 may include a variety of sensors for detecting conditions internal and external to the unit 10. These conditions can be fed to controller 64 which may make decisions regarding operation of unit 10 to rectify undesirable conditions or to otherwise condition the flow of air 114 into the room. For example, as best illustrated in FIG. 7, unit 10 may include an indoor temperature sensor 120 which is positioned and configured for measuring the indoor temperature within the room. In addition, unit 10 may include an indoor humidity sensor 122 which is positioned and configured for measuring the indoor humidity within the room. In this manner, unit 10 may be used to regulate the flow of air 114 into the room until the measured indoor temperature reaches the desired target temperature and/or humidity level. According to example embodiments, unit 10 may further include an outdoor temperature sensor for measuring ambient outdoor temperatures.

As used herein, "temperature sensor" or the equivalent is intended to refer to any suitable type of temperature measuring system or device positioned at any suitable location for measuring the desired temperature. Thus, for example, temperature sensor 120 may each be any suitable type of temperature sensor, such as a thermistor, a thermocouple, a resistance temperature detector, a semiconductor-based integrated circuit temperature sensor, etc. In addition, temperature sensor 120 may be positioned at any suitable location and may output a signal, such as a voltage, to a controller that is proportional to and/or indicative of the temperature being measured. Although example positioning of temperature sensors is described herein, it should be appreciated that unit 10 may include any other suitable number, type, and position of temperature, and/or other sensors according to alternative embodiments.

As used herein, the terms "humidity sensor" or the equivalent may be intended to refer to any suitable type of humidity measuring system or device positioned at any suitable location for measuring the desired humidity. Thus, for example, humidity sensor 122 may refer to any suitable type of humidity sensor, such as capacitive digital sensors, resistive sensors, and thermal conductivity humidity sensors. In addition, humidity sensor 122 may be positioned at any suitable location and may output a signal, such as a voltage, to a controller that is proportional to and/or indicative of the humidity being measured. Although example positioning of humidity sensors is described herein, it should be appreciated that unit 10 may include any other suitable number, type, and position of humidity sensors according to alternative embodiments.

Now that the construction of air conditioner unit 10 and the configuration of controller 64 according to example embodiments have been presented, example methods 200 and 300 of operating a packaged terminal air conditioner unit will be described. Although the discussion below refers to the example methods 200 and 300 of operating air conditioner unit 10, one skilled in the art will appreciate that the example methods 200 and 300 are applicable to the operation of a variety of other air conditioning appliances, such as an inverter window air conditioner. In example embodiments, the various method steps as disclosed herein may be performed by controller 64 or a separate, dedicated controller.

Generally, the holiday occurrence may correspond to the scheduled religious celebration or event, such as a Sabbath in accordance with Orthodox Jewish customs. The holiday occurrence may be indicated (e.g., manually) by a user's selection of a holiday or Sabbath mode at control panel 66. Alternatively, the holiday occurrence may be determined automatically from a programmed clock or calendar maintained on controller 64. Thus, a holiday start time and holiday end time may be determined for the holiday occurrence. At the holiday start time, a holiday mode may be initiated. Further described herein, methods 200 and 300 are methods describing the operation of air conditioner unit 10 in a Sabbath mode.

Figure 8:
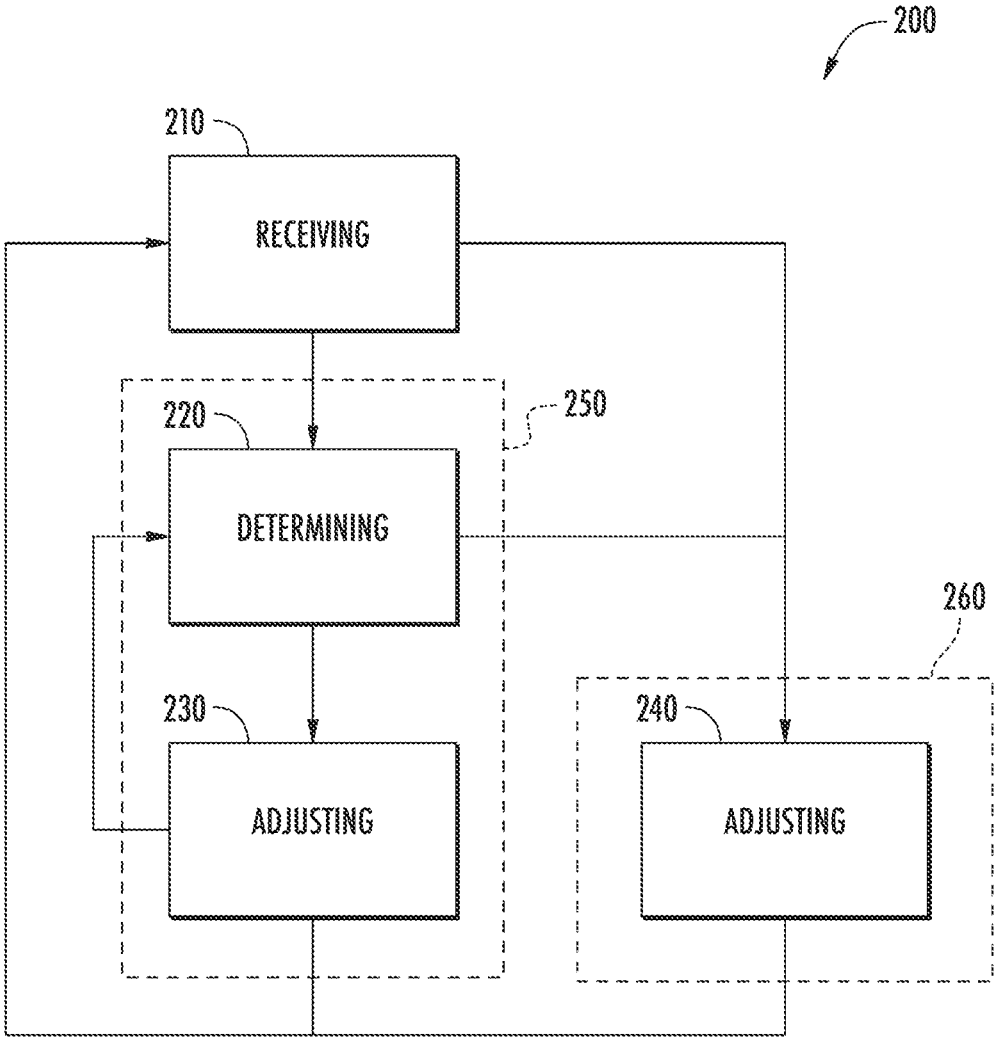
FIG. 8 illustrates a method for operating an air conditioner unit in accordance with one example embodiment of the present disclosure.

Referring now to FIG. 8, method 200 includes, at 210, controller 64 receiving a signal from an outdoor temperature sensor. The signal may be a temperature reading of the external air. As an example, the temperature reading may be an average of twenty consecutive readings, one-hundred milliseconds apart, for two total seconds. At 220, controller 64 may determine that the temperature reading from the outdoor temperature sensor is above a threshold value. Proceeding to 230, controller 64 may adjust compressor 34 and fans 32 and 42 from an off state to an operating state. In the process of 220 and 230, a timer defined by 250 may start. The timer at 250 may be configured to be a random length of time of no less than thirty seconds (30 s) and no greater than ninety seconds (90 s), preferably forty-five (45 s) to sixty seconds (60 s). At 220, controller 64 may determine that the timer at 250 has been reached, at which point controller 64 may go to 210 again and receive a room temperature from temperature sensor 120. As an example, the room temperature reading may be an average of twenty consecutive readings, one-hundred milliseconds apart, for two total seconds. Controller 64 may compare the room temperature signal against a set temperature plus two degrees.

For example, in a scenario where the room temperature is greater than the set temperature plus two degrees, the process will repeat through 210, 220, 230, with a new timer at 250, until the room temperature is less than the set temperature plus two degrees. In an example where the room temperature is less than the set temperature plus two degrees, the process may proceed to 240. At 240, controller 64 may adjust compressor 34 and fans 32 and 42 from the operating state to off. When compressor 34 and fans 32 and 42 are turned off at 240, a timer defined by 260 may be started. The timer at 260 may be a timer of no less than ten minutes (10 m) and no greater than twenty minutes (20 m), preferably about fifteen minutes (15 m). At the conclusion of the timer at 260, controller 64 may repeat the process over again starting at 210.

Figure 9:
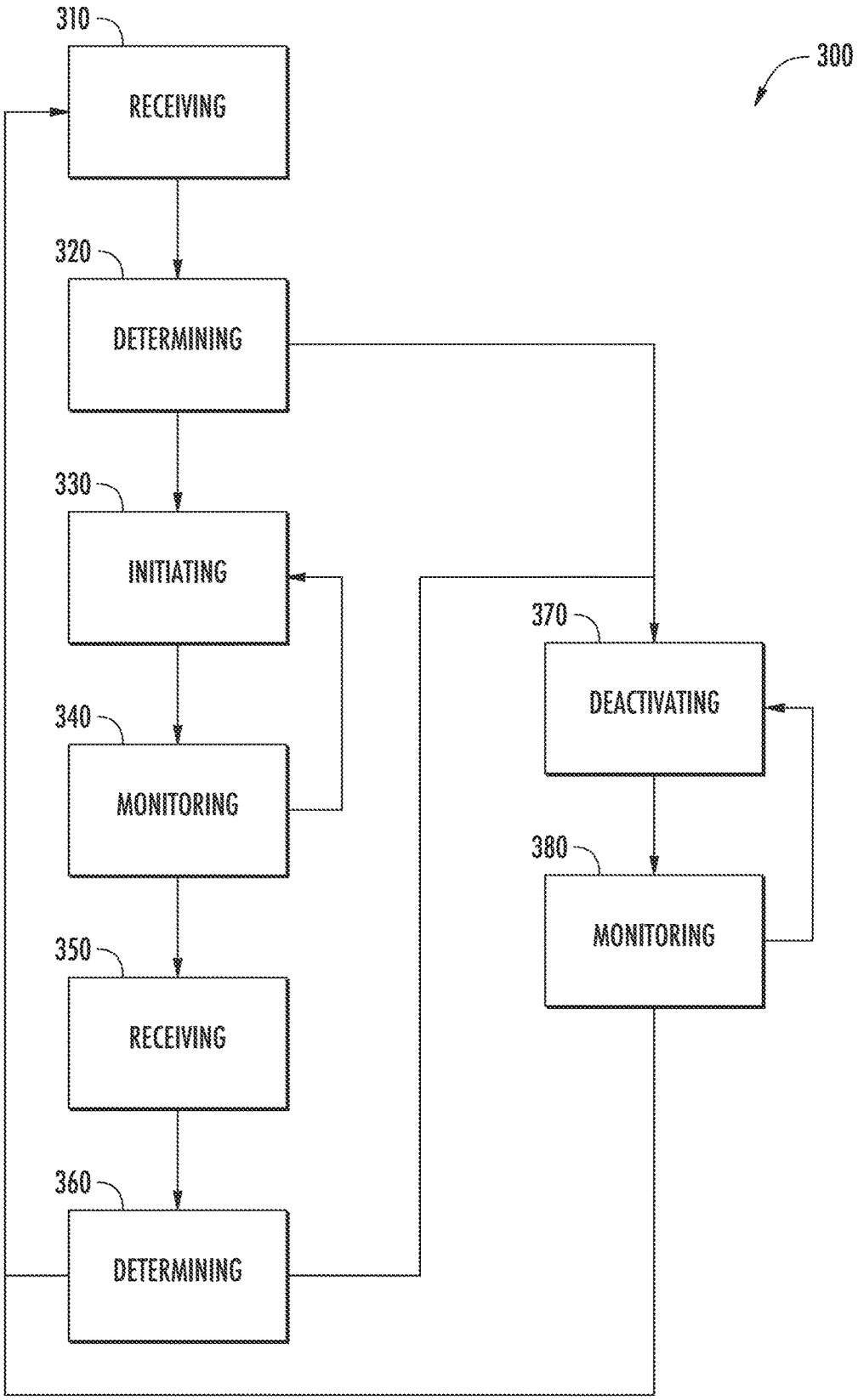
FIG. 9 illustrates another method for operating an air conditioner unit in accordance with one example embodiment of the present disclosure.

Referring now to FIG. 9, method 300 includes, at 310, controller 64 receiving a signal from an outdoor temperature sensor. The signal may be a temperature reading of the external air. As an example, the temperature reading may be an average of twenty consecutive readings, one-hundred milliseconds apart, for two total seconds. At 320, controller 64 may determine that the temperature reading from the outdoor temperature sensor is above a threshold value of about eighteen degrees Celsius (18° C.). If the temperature reading from the outdoor temperature sensor is below the threshold value, the process proceeds to 370, described in further detail herein. Once controller 64 determines that the temperature reading from the outdoor temperature sensor is above the threshold value the process proceeds to 330. At 330, controller 64 may initiate compressor 34 and fans 32 and 42, turning on the air conditioning unit. Once compressor 34 and fans 32 and 42 are initiated, at 340 a timer may start and controller 64 may begin monitoring the timer until the limit has been met. The timer at 340 may be configured to be a random length of time of no less than thirty seconds (30 s) and no greater than ninety seconds (90 s), preferably forty-five second (45 s) to sixty seconds (60 s). As long as the timer at 340 is not met, compressor 34 and fans 32 and 42 may remain on. When the time limit of the timer being monitored at 340 by controller 64 is met, the process proceeds to 350. At 350, controller 64 may receive a room temperature reading from temperature sensor 120. As an example, the room temperature reading may be an average of twenty consecutive readings, one-hundred milliseconds apart, for two total seconds. At 360, controller 64 may compare the room temperature received in 350 against a set temperature plus two degrees.

For example, in a scenario where the room temperature is greater than the set temperature plus two degrees, the process will repeat through 310, 320, assuming the outside temperature is still above eighteen degrees (18° C.) 330, 340, 350, and again to 360, with a new timer at 340. This process repeats until the room temperature is less than the set temperature plus two degrees. When the room temperature is less than the set temperature plus two degrees, the process may proceed to 370. At 370, controller 64 may deactivate compressor 34 and fans 32 and 42 or keep compressor 34 and fans 32 and 42 off if the process has come directly from 320 as mentioned above. When compressor 34 and fans 32 and 42 are turned off at 370, a timer is started and may be monitored at step 380. The timer being monitored at 380 may be a timer of no less than ten minutes (10 m) and no greater than twenty minutes (20 m), preferably fifteen minutes (15 m). At the conclusion of the timer at 380, controller 64 may repeat the process over again starting at 310.

As seen from the above, air conditioner unit 10 is an air conditioner that can be used during the religious holiday observed by the Orthodox Jewish community in Sabbath mode. Once activated, Sabbath mode directs the operation of air conditioner unit 10 so that users may abide by the rules of the religious holiday. At the start, the outdoor temperature may be sampled, and if the outdoor temperature is below the threshold value, air conditioner unit 10 may enter a stage where compressor 34 and fans 32 and 42 are de-energized/off. Air conditioner unit 10 may stay in this stage until the outdoor temperature rises above the threshold value. When this happens, compressor 34 and fans 32 and 42 may energize/start and begin cooling the room. This action may be set to last as long as a randomized timer set between forty-five and sixty seconds. At the end of the timer, the room temperature will be sampled and compared to the set temperature. If the room temperature is above the set temperature, the process will be repeated.

FIGS. 8 and 9 depict steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of methods 200, 300 are explained using air conditioner unit 10 as an example, it should be appreciated that these methods may be applied to the operation of any suitable air conditioning unit.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of Sabbath mode in an air conditioning unit comprising:

determining, at a controller of the air conditioning unit, that a Sabbath mode is active;

initiating, with the controller of the air conditioning unit, operation of a compressor in the air conditioning unit, the compressor flowing refrigerant through a sealed system of the air conditioning appliance, the sealed system comprising a heat exchanger, wherein initiating operation of the compressor comprises operating the compressor between 1500 revolutions per minute and 3500 revolutions per minute;

determining, at the controller of the air conditioning unit, that a random length of time between thirty seconds and ninety seconds has passed since the initiation of the operation of the compressor;

adjust the operation of the compressor from an operating state to a deactivation state after the random length of time has lapsed;

receiving, at the controller of the air conditioning unit, a temperature signal from a temperature sensor, while in the Sabbath mode;

determining, at the controller of the air conditioning unit, that the temperature signal is one of above or below a threshold value, while in the Sabbath mode; and adjusting, with the controller of the air conditioning unit, operation of the compressor in the air conditioning unit from the deactivation state to the operating state for the determined random length of time while in the Sabbath mode.

2. The method of claim 1, further comprising initiating a timer upon the adjusting of the operation of the compressor, the controller configured to monitor the timer and readjust operation of the compressor after the timer elapses.

3. The method of claim 1, wherein the temperature sensor is positioned at an exterior side of the air conditioning unit.

4. The method of claim 1, wherein the threshold value is about eighteen degrees Celsius.

5. The method of claim 2, further comprising implementing a first timer and a second timer, wherein adjusting operation of the compressor comprises activating the compressor for the first timer and deactivating the compressor for the second timer.

6. The method of claim 5, wherein the first timer is a randomized time no less than forty-five seconds and no greater than sixty seconds.

7. The method of claim 5, wherein the second timer is a fixed time of about fifteen minutes.

8. A method of Sabbath mode in an inverter window air conditioning unit, comprising:

receiving, at a controller of the air conditioning unit, a temperature signal from an external temperature sensor;

determining, at the controller of the air conditioning unit, that the temperature signal from the external temperature sensor is above a threshold value of about eighteen degrees Celsius;

initiating, with the controller of the air conditioning unit, operation of a compressor in the air conditioning unit, the compressor flowing refrigerant through a sealed system of the air conditioning appliance, the sealed system comprising a heat exchanger, wherein initiating operation of the compressor comprises operating the compressor between 1500 revolutions per minute and 3500 revolutions per minute;

determining, at the controller of the air conditioning unit, that a random length of time between thirty seconds and ninety seconds has passed since the initiation of the operation of the compressor;

determining, at the controller of the air conditioning unit, that a room temperature is one of above or below a set temperature, plus about two additional degrees;

deactivating, with the controller of the air conditioning unit, operation of the compressor in the air conditioning unit in response to the determination of the room temperature; and determining, at the controller of the air conditioning unit, that a length of time of at least ten minutes has passed to repeat the initiating of the operation of the compressor, the determination of the random length of time, the determination of the room temperature, and the deactivation of the operation of the compressor.

9. The method of claim 8, wherein the set temperature is a value set by a user of the air conditioning unit.

10. An inverter window air conditioning unit, comprising:

a housing;

an interior heat exchanger positioned within the housing at an inside portion of the housing;

an exterior heat exchanger positioned within the housing at an outside portion of the housing;

a compressor operable to flow working fluid through the interior and exterior heat exchangers;

a temperature sensor configured for measuring a temperature of air;

a controller configured for:

determining that a Sabbath mode is active, initiating operation of a compressor in the air conditioning unit, the compressor configured to flow refrigerant through a sealed system of the air conditioning appliance, the sealed system comprising the interior heat exchanger and the exterior heat exchanger, wherein initiating operation of the compressor comprises operating the compressor between 1500 revolutions per minute and 3500 revolutions per minute;

determining that a random length of time between thirty seconds and ninety seconds has passed since the initiation of the operation of the compressor;

adjusting the operation of the compressor from an operating state to a deactivation state after the random length of time has lapsed;

receiving a temperature signal from the temperature sensor while in the Sabbath mode;

determining that the temperature signal is one of above or below a threshold value while in the Sabbath mode; and adjusting operation of the compressor from the deactivation state to the operating state for the determined random length of time while in the Sabbath mode.

11. The air conditioning unit of claim 10 wherein the temperature sensor is positioned at the exterior side of the housing.

12. The air conditioning unit of claim 10, wherein the controller is configured for adjusting the operation of the compressor by activating or deactivating the compressor.

13. The air conditioning unit of claim 12, wherein the controller is further configured for implementing a first timer and a second timer, wherein adjusting operation of the compressor comprises activating the compressor for the first timer and deactivating the compressor for the second timer.

14. The air conditioning unit of claim 13, wherein the first timer is a randomized time no less than forty-five seconds and no greater than sixty seconds.

15. The air conditioning unit of claim 13, wherein the second timer is a fixed time of about fifteen minutes.

* * * * *